US010221856B2

(12) United States Patent
Hernandez et al.

(10) Patent No.: US 10,221,856 B2
(45) Date of Patent: Mar. 5, 2019

(54) PUMP SYSTEM AND METHOD OF STARTING PUMP

(71) Applicant: BJ Services, LLC, Tomball, TX (US)

(72) Inventors: Jennifer Hernandez, Humble, TX (US); Bruce A. Vicknair, The Woodlands, TX (US); Blake C. Burnette, Tomball, TX (US); Pierce Dehring, Tomball, TX (US)

(73) Assignee: BJ Services, LLC, Tomball, TX (US)

( * ) Notice: Subject to any disclaimer, the term of this patent is extended or adjusted under 35 U.S.C. 154(b) by 417 days.

(21) Appl. No.: 14/829,556

(22) Filed: Aug. 18, 2015

(65) Prior Publication Data

US 2017/0051732 A1 Feb. 23, 2017

(51) Int. Cl.

| | |
|---|---|
| ***F04D 25/02*** | (2006.01) |
| ***F04B 17/06*** | (2006.01) |
| ***F04B 17/03*** | (2006.01) |
| ***F04B 49/02*** | (2006.01) |
| ***F04B 53/00*** | (2006.01) |
| ***F04B 9/02*** | (2006.01) |
| ***F04B 49/20*** | (2006.01) |
| ***F04B 9/04*** | (2006.01) |
| ***F04B 15/02*** | (2006.01) |

(Continued)

(52) U.S. Cl.

CPC ..... *F04D 25/028* (2013.01); *F04B 9/02* (2013.01); *F04B 9/045* (2013.01); *F04B 15/02* (2013.01); *F04B 17/03* (2013.01); *F04B 17/06* (2013.01); *F04B 47/02* (2013.01); *F04B 49/02* (2013.01); *F04B 49/06* (2013.01); *F04B 49/20* (2013.01); *F04B 53/006* (2013.01); *F04D 25/02* (2013.01); *E21B 33/14* (2013.01); *E21B 37/00* (2013.01); *E21B 43/20* (2013.01); *E21B 43/24* (2013.01); *E21B 43/25* (2013.01); *E21B 43/26* (2013.01)

(58) Field of Classification Search

CPC ..... E21B 21/06; E21B 43/26; F04D 25/00; F04D 25/02; F04D 25/028; F04B 17/03; F04B 49/02

See application file for complete search history.

(56) References Cited

U.S. PATENT DOCUMENTS

| | | | |
|---|---|---|---|
| 3,300,697 | A | 1/1967 | Woodford |
| 4,078,452 | A | 3/1978 | Rosler |

(Continued)

FOREIGN PATENT DOCUMENTS

| | | | |
|---|---|---|---|
| CA | 2546315 | A1 | 11/2006 |
| EP | 2180590 | A1 | 4/2010 |
| WO | 2012122636 | A1 | 9/2012 |

OTHER PUBLICATIONS

Munyon, Robert E., et al. (1989) The Application of Flexible Couplings for Turbomachinery, Proceedings of the 18th Turbomachinery Symposium, Texas A&M University, College Station, Texas, 25pp.

(Continued)

*Primary Examiner* — Patrick Hamo

(74) *Attorney, Agent, or Firm* — Constance G. Rhebergen; Keith R. Derrington

(57) ABSTRACT

A pump system positionable at a surface of a well site for downhole operations includes a pump assembly having a pump and a starting assist. The pump includes a crankshaft and is operable by a first motor. The starting assist includes a second motor and a gear system.

21 Claims, 4 Drawing Sheets

(51) Int. Cl.

| | |
|---|---|
| ***F04B 47/02*** | (2006.01) |
| ***F04B 49/06*** | (2006.01) |
| *E21B 43/25* | (2006.01) |
| *E21B 43/20* | (2006.01) |
| *E21B 43/24* | (2006.01) |
| *E21B 43/26* | (2006.01) |
| *E21B 37/00* | (2006.01) |
| *E21B 33/14* | (2006.01) |

(56) References Cited

U.S. PATENT DOCUMENTS

| | | | |
|---|---|---|---|
| 4,159,180 | A | 6/1979 | Cooper et al. |
| 4,311,395 | A | 1/1982 | Douthitt et al. |
| 4,368,396 | A | 1/1983 | Humphrey |
| 4,649,307 | A | 3/1987 | Bech |
| 4,707,644 | A | 11/1987 | Miller et al. |
| 4,960,085 | A | 10/1990 | Coons |
| 5,213,414 | A | 5/1993 | Richard et al. |
| 5,258,651 | A | 11/1993 | Sherman |
| 5,839,888 | A | 11/1998 | Harrison |
| 6,109,122 | A | 8/2000 | Laszlo et al. |
| 6,230,805 | B1 | 5/2001 | Vercaemer et al. |
| 6,388,353 | B1 | 5/2002 | Liu et al. |
| 6,615,786 | B2 | 9/2003 | Mori et al. |
| 7,649,286 | B2 | 1/2010 | Manning |
| 7,849,831 | B2 | 12/2010 | Ono |
| 7,901,314 | B2 | 3/2011 | Salvaire et al. |
| 7,921,914 | B2 | 4/2011 | Bruins et al. |
| 8,475,311 | B2 | 7/2013 | Ren et al. |
| 8,764,411 | B2 | 7/2014 | Gibson et al. |
| 8,789,601 | B2 | 7/2014 | Broussard et al. |
| 8,795,118 | B2 | 8/2014 | Laszlo et al. |
| 8,827,853 | B2 | 9/2014 | Carl et al. |
| 9,395,049 | B2 | 7/2016 | Vicknair et al. |
| 2006/0260331 | A1 | 11/2006 | Andreychuk |
| 2008/0152517 | A1 | 6/2008 | Ishii et al. |
| 2008/0296909 | A1 | 12/2008 | Dipasquale, Jr. |
| 2009/0044951 | A1 | 2/2009 | Milkovisch et al. |
| 2009/0068031 | A1 | 3/2009 | Gambier et al. |
| 2010/0132949 | A1 | 6/2010 | Defosse et al. |
| 2012/0255734 | A1 | 10/2012 | Coli et al. |
| 2013/0045117 | A1 | 2/2013 | Wishart |
| 2013/0101438 | A1 | 4/2013 | Cedrone et al. |
| 2013/0306322 | A1 | 11/2013 | Sanborn et al. |
| 2014/0010671 | A1 | 1/2014 | Cryer et al. |
| 2014/0174717 | A1 | 6/2014 | Broussard et al. |
| 2014/0219824 | A1 | 8/2014 | Burnette |
| 2015/0027712 | A1 | 1/2015 | Vicknair et al. |
| 2015/0125311 | A1* | 5/2015 | Leifert ..... F04C 23/02 417/16 |
| 2015/0255210 | A1* | 9/2015 | Birnbach ..... G21B 1/03 336/105 |

OTHER PUBLICATIONS

Murphy, Jim (Apr. 1, 2012) Permanent-magnet AC Motors, Machine Design, 6 pp.

Baker Hughes (2012) Overview rhine pump units maximize pressure pumping efficiency and reliability, 1p.

Baker Hughes (2013) Case history rhino bifuel pumps replaced diesel with cleaner burning natural gas, 1p.

* cited by examiner

PUMP SYSTEM AND METHOD OF STARTING PUMP

BACKGROUND

In the drilling and completion industry, the formation of boreholes for the purpose of production or injection of fluid is common. Hydrocarbons such as oil and gas can be recovered from the subterranean formation using the boreholes. Various operations require the pumping of fluid into the borehole. In many instances, it is necessary to pump a large volume of fluid into the borehole. For example, hydraulic fracture stimulation operations often require the concurrent use of multiple fracturing fluid pumping units at a single well site in order to provide the desired quantity of fracturing fluid needed to fracture the earthen formation. Typically, multiple trailer or skid mounted hydraulic fracturing fluid pumping units, each including a single diesel motor, driveline and a single pump, are simultaneously used to provide the requisite demand of fracturing fluid into the borehole.

While the use of an electric motor in place of a diesel motor could reduce weight on the skid and create less undesirable exhaust emissions at the well site, large horsepower electric drives create large inrush starting currents (the maximum, instantaneous input current drawn by an electrical device when first turned on). The use of high capacity distribution wire and/or sub-station transformers forces higher watt-hour ("Wh") utility rates and other associated costs. The normal operating power of large electric driven pumps and compressors is approximately 0.15-0.25 of locked rotor start inrush. Mitigation schemes include variable frequency drive ("VFD") controls, soft-start devices, and reduced voltage operation. However, all of these starting methods are problematic in the harsh oilfield environment, with respect to one or more of size, weight, complexity, and cost.

Natural gas has also been employed to drive a dedicated on-site turbine generator to eliminate the need for a transmission in the production of electricity, to power the fracturing modules, blenders, and other on-site operations as necessary, including other local equipment, including coiled tubing systems and service rigs. The use of a dedicated power source has been preferred over grid power because during startup of a fracturing operation, massive amounts of power are required such that the use of grid power would be impractical. The potential for very large instantaneous adjustments in power drawn from the grid during a fracturing operation could jeopardize the stability and reliability of the grid power system, as well as result in increased costs passed on to the operator. Accordingly, a site-generated and dedicated source of electricity has provided a more feasible solution in powering an electric fracturing system. While providing an alternative to grid powered systems, the use of site-generated sources of electricity necessitates extra equipment at the well site.

The art would be receptive to alternative devices and methods useful in connection with enabling the use of electric motors in downhole fluid delivery operations without incurring the above-described problems.

BRIEF DESCRIPTION

A pump system positionable at a surface of a well site for downhole operations includes a pump assembly having a pump and a starting assist. The pump includes a crankshaft and is operable by a first motor. The starting assist includes a second motor and a gear system.

A method of starting a pump, operable by a first motor, in a pump system positionable at a surface of a well site for downhole operations, includes activating a second motor in a starting assist operatively connected to the pump, the starting assist rotating a crankshaft of the pump through a gear system; activating the first motor when the crankshaft rotates at a present frequency or a preset time has passed since the second motor was turned on; and deactivating the second motor while the first motor is rotating the crankshaft.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
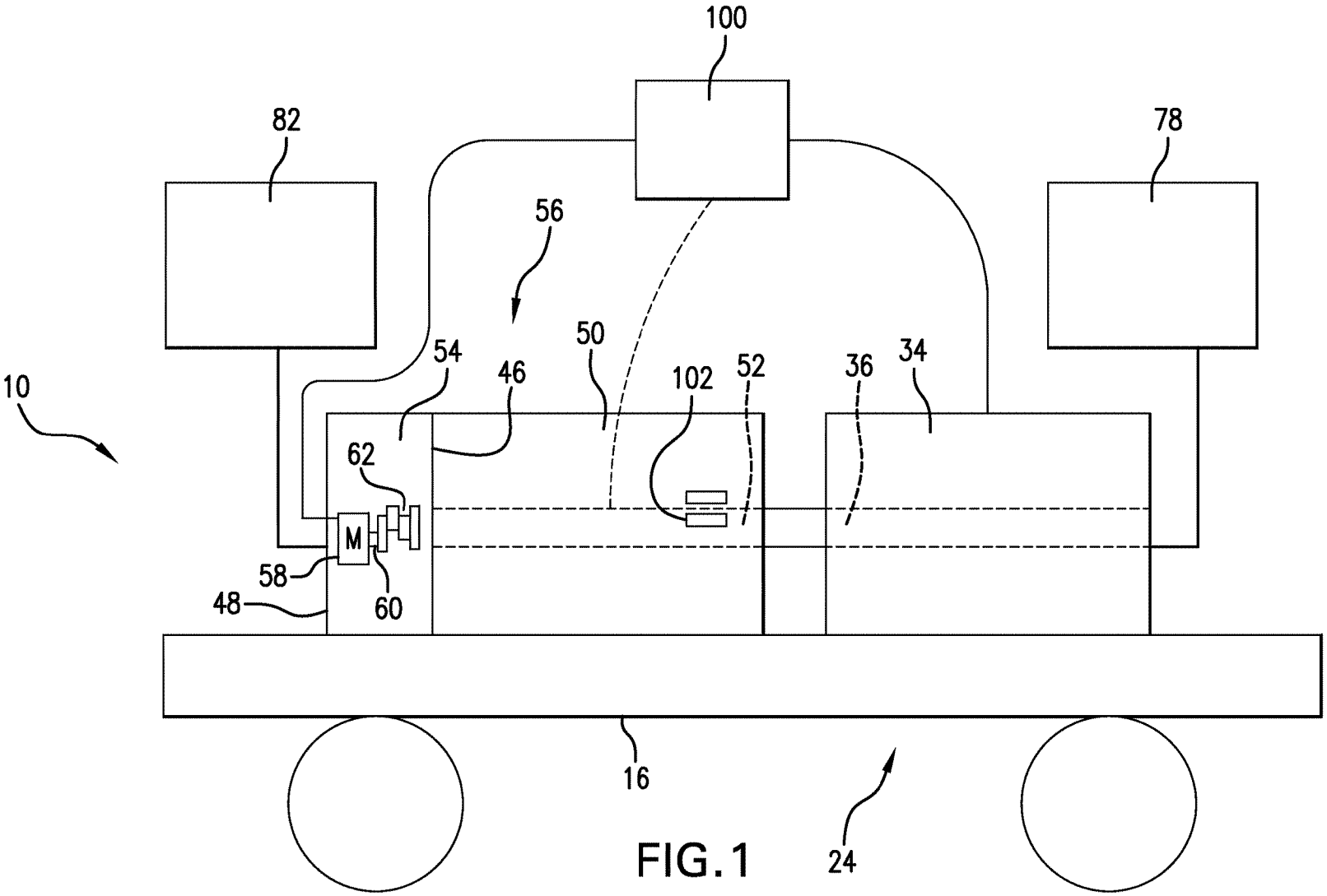
FIG. 1 is a schematic diagram of one embodiment of a pump system including a starting assist.
Figure 2:
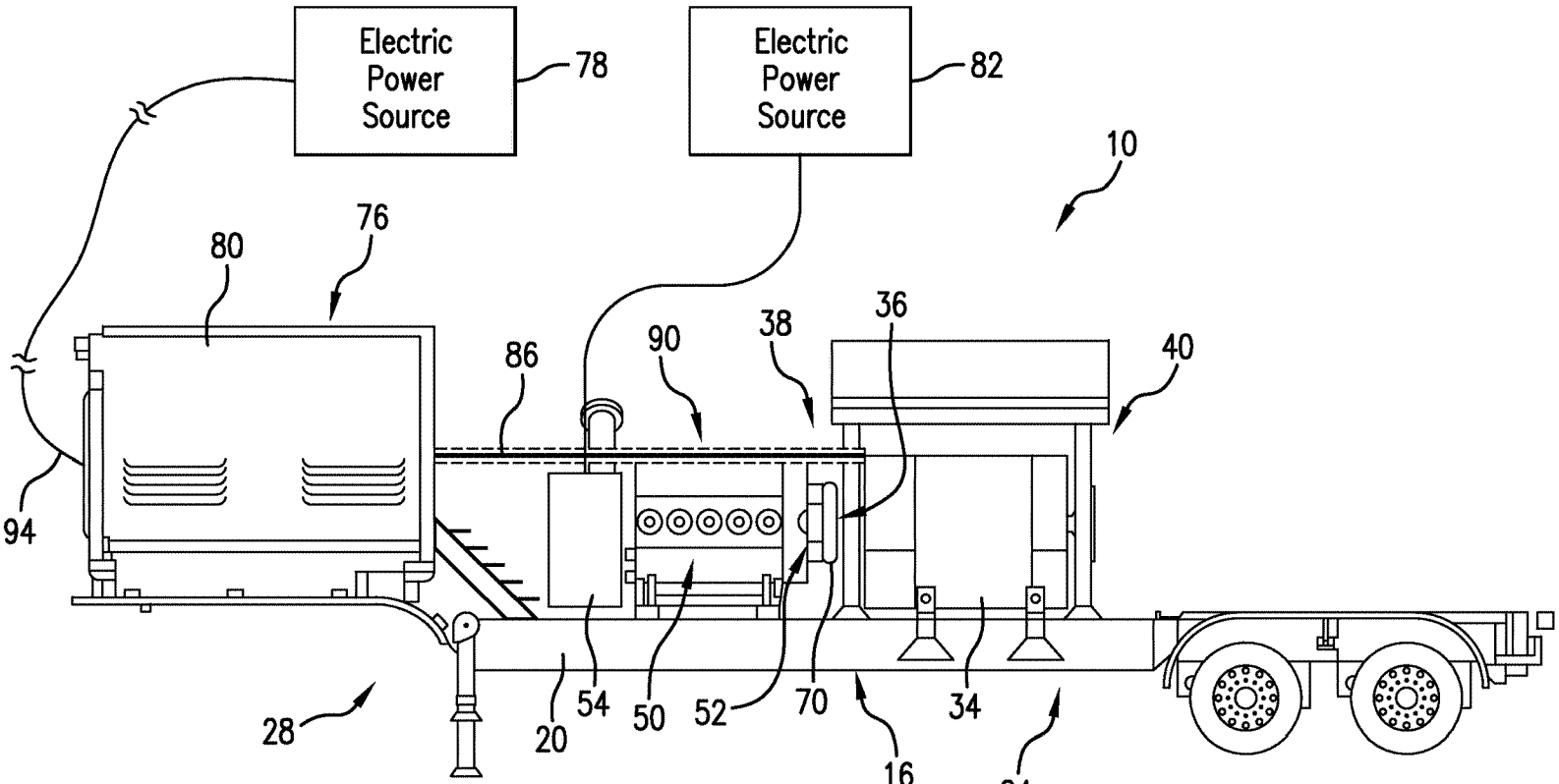
FIG. 2 is partial schematic and partial side view of one embodiment of the pump system shown mounted on a trailer.

Referring initially to FIGS. 1 and 2, there is shown an embodiment of a pump system 10. The pump system 10 may utilize a pump 50 for pumping fracturing fluid into a borehole (not illustrated), however the pump system 10 need not be limited to fracturing operations. The pump system 10 further includes a motor 34 for running the pump 50, such as, but not limited to an electric motor 34, including an induction motor. A pump assembly 56, which includes the pump 50, further includes a starting assist 54 for rotating a driveshaft 52 (such as a crankshaft) of the pump 50 before the motor 34 is turned on. The pump assembly 56 may include a housing 48 that encloses both the internal components of the pump 50 and the starting assist 54 therein. An interior divider 46 may be provided between the starting assist 54 and the internal components of the pump 50, and the driveshaft 52 may extend through the divider 46. The starting assist 54 may also be retrofitted onto the housing 48 of the pump 50. Rotation of the driveshaft 52 results in a lower inrush current of the motor 34 when the motor 34 is eventually turned on to rotate the driveshaft 52. Where any rotation of the driveshaft 52 yields an exponential decrease in current, the faster the driveshaft 52 is turning, the lower the inrush. The driveshaft 52 may be at n/rpm for exponential reduction of inrush current upon applying main power to the motor 34. In one embodiment, the starting assist 54 is positioned at one end of the driveshaft 52, and the motor 34 is positioned at an opposite end of the driveshaft 52. The pump system 10 further includes at least one external electric power source 78, 82 for providing electric power to the starting assist 54 and the electric motor 34. The external electric power source 78, 82 may be the same, or alternatively may be a plurality of different electric power sources 78, 82. The electric power sources 78, 82 may have any suitable form, configuration, operation and location. If desired, the pump system 10 may be configured so that the external electric power source(s) 78, 82, may be off-site relative to the location of a carrier 24. For example, the external electric power source 78 may be one or more gas turbine generator (not shown) remotely located relative to the well-site and electrically coupled to a variable frequency drive VFD 76, such as with one or more medium voltage cable 94 (e.g. 15 kv class cable). For another example, the external electric power sources 78, 82 may be a local utility power grid remotely located relative to the well-site and connectable to the VFD 76 and starting assist 54 through any suitable source, such as distribution or transmission line, sub-station, breaker panel on another carrier (not shown). Thus, the system 10 may be transported between multiple well sites and connected to and disconnected from external power sources at each well site, or as desired. Grid power may be selected as the external electric power sources 78, 82 because large inrush currents are eliminated through use of the starting assist 54.

An embodiment of the pump system 10 may be provided on a mobile chassis 16. The pump system 10 provides a high volume of fluid from the chassis 16 into an underground borehole. The chassis 16 may have any suitable form, configuration and operation. The illustrated chassis 16 is mounted on, or integral to, a carrier 24. As used herein, the terms "carrier" and variations thereof refers to any transportable or movable device, such as, for example, a skid or other frame, trailer, truck, automobile and other types of land-based equipment, a ship, barge and other types of waterborne vessels, etc. In some embodiments, the chassis 16 and carrier 24 may essentially be one in the same, such as in some instances when the chassis 16 is a skid. In one embodiment, for example, the carrier 24 may be an 18-wheel trailer 28, and the chassis 16 may include an elongated frame 20 that is mounted on, or integral to, the trailer 28. The chassis 16 is thus transportable between locations, such as between multiple well sites. It should be understood, however, that alternate types of chassis 16 and carriers 24 may be utilized with the pump system 10, or that the pump system 10 may be merely installed at a more permanent fixture at a well site.

The pump system 10 including the electric motor 34 and the pump assembly 56 are disposable upon the chassis 16. The motor 34 drives the pump 50, which pump (typically pressurized) fluid into the borehole, such as for hydraulic fracturing of the adjacent earthen formation, acid stimulation, work-over or remediation operations, as is and may become further known.

The motor 34 includes the drive shaft 36 extending axially therethrough and outwardly at a first end 38 and coupled thereto to the drive shaft 52 of the rump 50 when rotating the drive shaft 52. In one embodiment, the motor 34 may be a single or multi speed fixed frequency induction motor. In one embodiment, the electric motor 34 may be, but is not limited to, a permanent magnet AC motor. The illustrated pump 50 may, for example, be high horsepower plunger-style, triplex or quintuplex, fluid pump, and may have a power rating dependent on the HP of the motor 34. However, the present disclosure is not limited to the above details or examples, and any suitable motor 34 and pump 50 may be used. The use of an electric motor 34 verses a conventional diesel motor has one or more advantages. For example, the electric motor 34 may require fewer related components (e.g. transmission, gear box) and thus have a lighter weight (and potentially smaller footprint). Reducing weight on the chassis 16 is beneficial, for example, in jurisdictions having weight limits on equipment transported to or located at a well site, allowing greater pumping capacity within strict weight requirements. For another example, reducing weight on the chassis 16 may enable inclusion of second or additional fluid rumps 50 and motors 34 on a single chassis 16, thus increasing pumping capacity. For another example, use of the electric motor 34 instead of one or more diesel motors may cause less undesirable exhaust emissions at the well site, reducing the need for on-site emissions control operations. For yet another example, the electric motor 34 may not produce as much heat as the diesel motor. Consequently, if desired, a second electric motor and second fluid pump may be stacked atop the first set of electric motor 34 and fluid pump 50 on the chassis 16. (The second set of an electric motor and pump may otherwise be configured and operate the same as described herein with respect to the electric motor 34 and pump 50.) Thus, the carrier 24 may have two sets of motors 34 and pumps 50, essentially doubling the fluid pumping capacity of the system 10 as compared to a conventional system.

In one embodiment, a flex coupling 70 may be engaged between the motor 34 and pump 50. The flex coupling 70 may be useful, for example, to allow the motor 34 and pump 50 to move relative to one another during operations without disturbing their interconnection and operation or any other suitable purpose. The flex coupling 70 may have any suitable form, configuration and operation. For example, the flex coupling 70 may be a commercially available high horsepower diaphragm, or elastic, coupling. Likewise, the flex coupling 70 may be engaged between the motor 34 and pump 50 in any suitable manner. For example, a flex coupling 70 may be disposed around the drive shaft 36 of the electric motor 34 at the end 38 thereof. At the end 38, the flex coupling 70 may be connected to and engaged between an oilfield drive-line flange (not shown) on the motor 34 and an oilfield drive-line flange (not shown) on the pump 50. It should be understood, however, any suitable coupling may be used to allow relative movement of the motor 34 and pump 50 without disturbing the operation thereof.

The electric motor 34 may be controlled in any suitable manner, after the rotation of the driveshaft 52 of the pump 50 by the starting assist 54 has reached a preset rotation speed that would effectively reduce the inrush current of the motor 34. In one embodiment, the speed of the electric motor 34 may be controllable by a variable frequency drive ("VFD") 76 disposed upon the chassis 16. The VFD 76 may be included because it is simple and easy to use, inexpensive, contributes to energy savings, increases the efficiency and life of, reduces mechanical wear upon and the need for repair of the electric motor 34, and any other suitable purpose or a combination thereof. Further, positioning the VFD 76 on the chassis 16 eliminates the need for a separate trailer housing typically used to house the control system for conventional fracturing fluid pumping systems. The VFD 76 may have any suitable configuration, form and operation and may be connected with the motor 34 and at least one external electric power source 78 in any suitable manner. In the illustrated embodiment shown in FIG. 2, the VFD 76 is mounted on the chassis 16 behind a protective access panel 80, and electrically coupled to the electric motor 34 via one or more bus bars 86. In one embodiment, the bus bar(s) 86 may be sized and configured to reduce or eliminate the loss of electric power occurring with the use of one or more interconnecting cable. Further, the use of bus bars 86 may eliminate the need for a series of large cumbersome cables. The bus bar(s) 86 may have any suitable form, configuration and operation. In one embodiment, as shown in FIG. 2, multiple bus bars 86 may be disposed upon a spring-loaded mounting (not shown) and at least partially covered and protected by a dust cover 90. However, the above configuration of a VFD 76 and bus bars 86 is not required for all embodiments. Furthermore, any other suitable electric speed varying device known, or which becomes known, to persons skilled in the art can be used to provide electric power to the motor 34 from the external power source 78.

Further, in another embodiment, the VFD 76 may be remotely controllable via a remote control unit (not shown) located at a remote, or off-site, location, or via automatic control from an external process control signal. Remote control of the VFD 76 may be included for any suitable reason, such as to avoid the need for an on-site operator and/or to reduce cost. Any suitable technique may be used for remotely controlling the VFD 76, such as via wireless, fiber optics or cable connection. Alternately or additionally, the VFD 76 may include an operator interface (not shown) mounted on the chassis 16 to allow an on-site operator to control the VFD 76 (e.g. to start and stop the motor 34 and adjust its operating speed and other functions) or override the remote control functions.

The pump 50 of the pump assembly 56 is a positive displacement pump, in particular a reciprocating pump. The pump 50, in one embodiment, is usable for a fracturing application in which fracturing fluid, such as, but not limited to a proppant filled slurry, is pumped downhole into a borehole for creating and potentially propping fractures in a formation. While particularly suited for a fracturing application, the pump system 10 may be employed in other applications. Each pump 50 includes a power assembly, sometimes referred to as a power end, and a fluid assembly, sometimes referred to as a fluid end. The power assembly includes a crankshaft housing which houses the driveshaft 52 (crankshaft) as will be further described below with respect to FIG. 3. A crosshead assembly may be interposed between the power assembly and the fluid assembly. The crosshead assembly converts rotational movement within the power assembly into reciprocating movement to actuate internal pistons or plungers of the fluid assembly. The pump 50 may include any number of internal pistons to pump the fluid in the fluid assembly, such as, but not limited to, a triplex pump having three pistons, or a quintuplex pump having five pistons. The fluid assembly of the pump 50 includes an input valve connected to an inlet and an output valve connected to an outlet. The inlet of the pump 50 is connected to a source of fluid, such as a proppant filled slurry. The outlet of the pump 50 may be connected to hoses, piping or the like to direct pressurized fluid to a borehole. Withdrawal of a piston during a suction stroke pulls fluid into the fluid assembly through the input valve that is connected to the inlet. Subsequently pushed during a power stroke, the piston then forces the fluid under pressure out through the output valve connected to the outlet.

Figure 3:
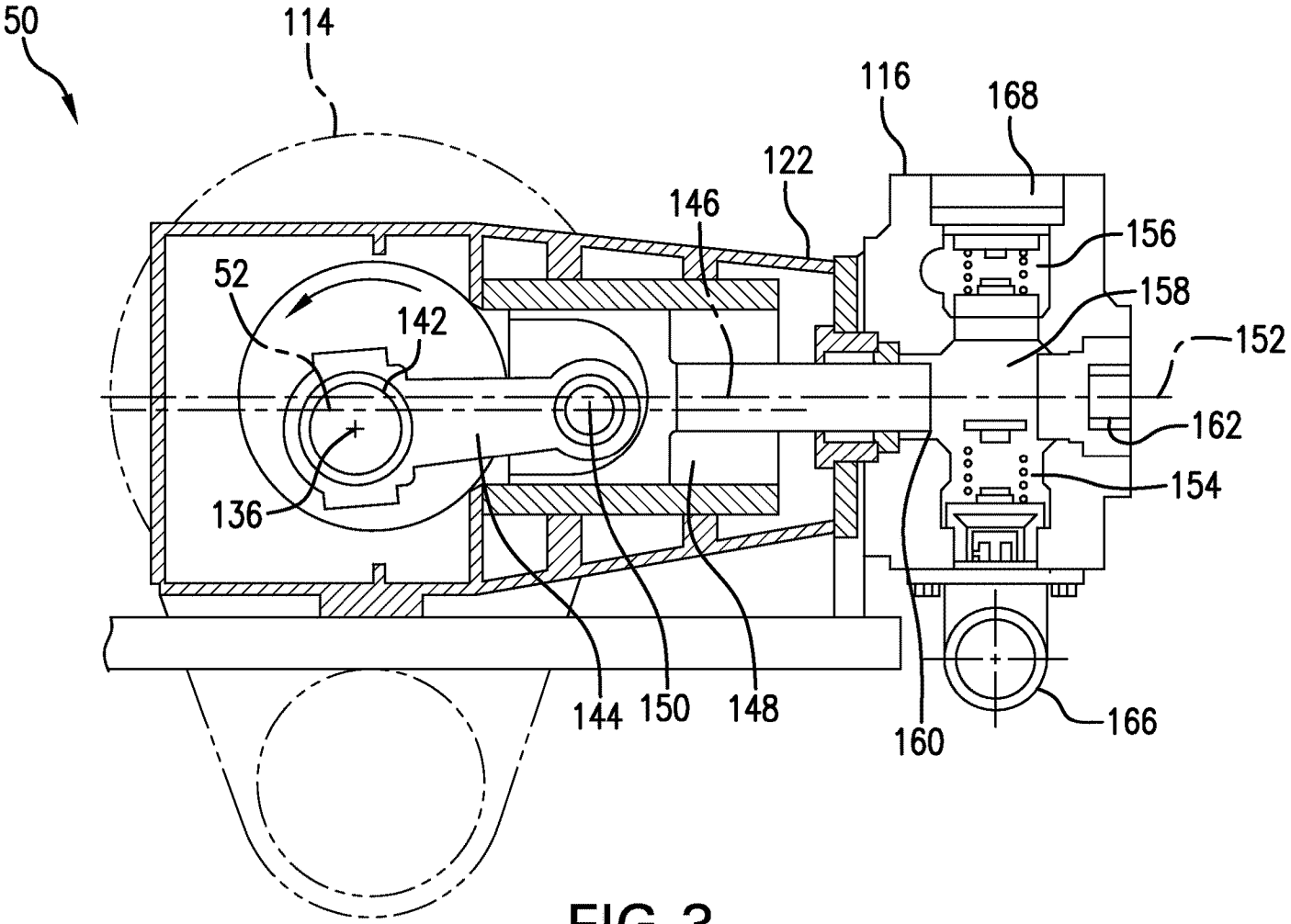
FIG. 3 is a cross-sectional view of a pump usable in the pump system of FIGS. 1 and 2.

One embodiment of the internal mechanics of the pump 50 is shown in FIG. 3. The power assembly 114 includes a crankshaft 52 (drive shaft 52) rotatable about a longitudinal axis 136. The crankshaft 52 includes a plurality of eccentrically arranged crankpins 142 (or alternatively a plurality of eccentric sheaves), and a connecting rod 144 is connected to each crankpin 142. The connecting rods 144 connect the crankpins 142 to the pistons 146 via, the crosshead assembly 122. The connecting rods 144 are connected to a crosshead 148 using a wrist pin 150 that allows the connecting rods 144 to pivot with respect to the crosshead 148, which in turn is connected to the pistons 146. The longitudinal axis 152 of each of the pistons 146 is perpendicular to the longitudinal axis (rotational axis) 136 of the crankshaft 52. When the crankshaft 52 turns, the crankpins 142 reciprocate the connecting rods 144. Moved by the connecting rods 144, the crosshead 148 reciprocates inside fixed cylinders. In turn, the pistons 146 coupled to the crosshead 148 also reciprocate between suction and power strokes in the fluid assembly 116. Input valves 154 are connected to the inlet 166 and output valves 156 are connected to the outlet 168. The fluid assembly 116 includes vertical passages 158 for passing fluid from each of the input valves 154 to respective output valves 156. The fluid assembly 116 also includes horizontal passages 160 that are directed along the longitudinal axis 152 of the pistons 146. The horizontal passages 160 are in fluid communication with the vertical passages 158. Withdrawal of a piston 146 during a suction stroke pulls fluid into the fluid assembly 116 through an input valve 154 that is connected to an inlet 166. Subsequently pushed during a power stroke, a piston 146 then forces the fluid under pressure out through the output valve 156 connected to an outlet 168. Pressure relief valves 162 are further included at a location opposite the pistons 146, at an end of the horizontal passages 160 of the fluid assembly 116, and are employed if a predetermined pressure threshold is reached within the first horizontal passages 160.

The starting assist 54 includes both a motor 58 (FIG. 1) having a drive shaft 60 and a gear set 62 (as will be further described with respect to FIGS. 4 and 5) such that the motor 58 is geared down from input to output. The motor 58 may be generally smaller than the motor 34, both in physical size as well as power rating (lower HP than the HP of the motor 34). Even though the motor 58 is smaller than the motor 34, it is geared down so as to start rotating the drive shaft 52 of the pump 50 prior to the motor 34 being turned on and engaging with the drive shaft 52. The starting assist 54 overcomes the initial starting friction of the pump 50 before the motor 34 is started up. In this way, the motor 34 can actually be smaller than a motor 34 would otherwise be if starting the pump 50 without the starting assist 54 of the pump assembly 56.

Figure 4:
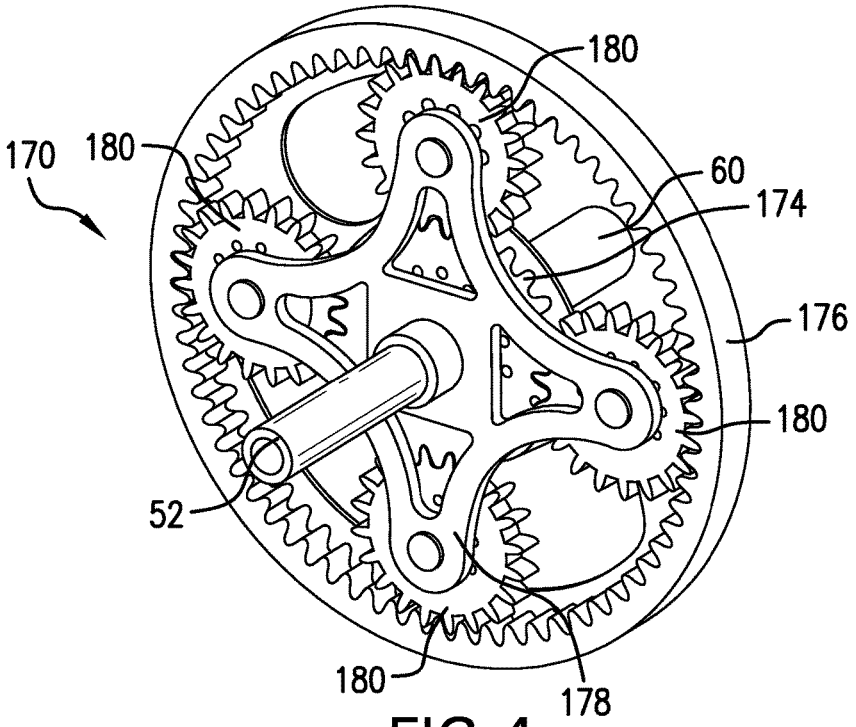
FIG. 4 is a perspective view of one embodiment of a planetary gear system usable in the starting assist of the pump system of FIGS. 1 and 2; and, FIG. 5 is a perspective view of one embodiment of a gear train usable in the starting assist of the pump system of FIGS. 1 and 2.
Figure 5:
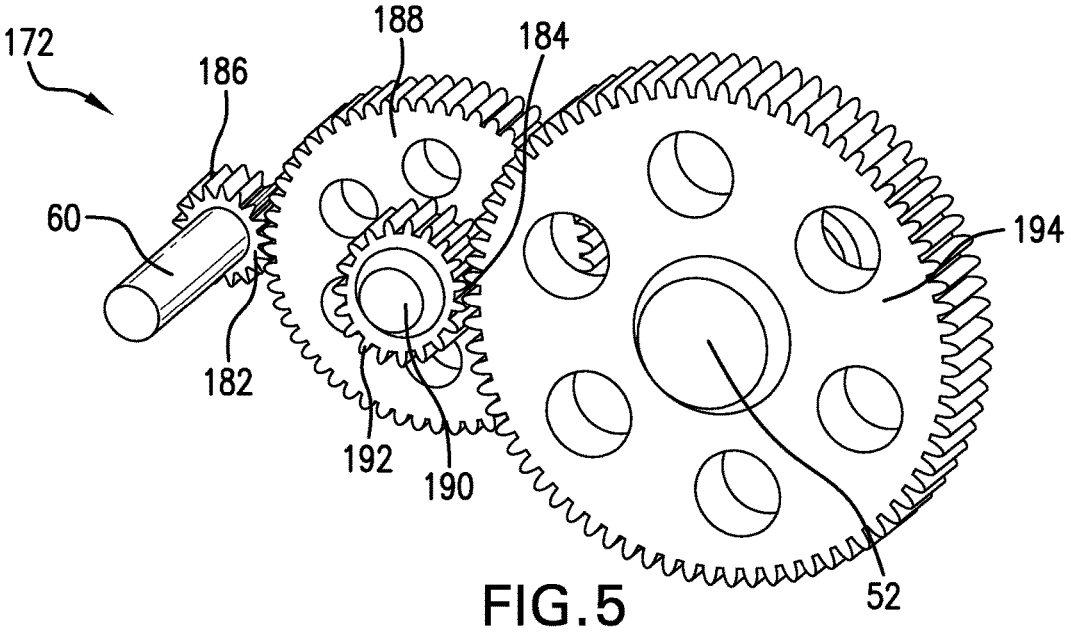

While any gear set 62 may be utilized in the starting assist 54 that provides the necessary gear ratio with gear reduction, FIGS. 4 and 5 illustrate a planetary gear system 170 and a fixed axis gear system 172, respectively, as two possible gear sets 62 employable as a gear train in the starting assist 54. In the planetary gear system 170, if an input (the driveshaft 60 of the motor 58) is connected to a sun gear 174, a ring gear 176 is held stationary, and an output (the drive shaft 52 of the pump 50) is connected to a planet carrier 178, then the planet carrier 178 and planet gears 180 orbit the sun gear 174 to provide an X:Y gear reduction, where X>Y. That is, for every X revolutions of the drive shaft 60, the drive shaft 52 will rotate Y revolutions. The rotational speed of the drive shaft 60 in the starting assist 54 converts to a slower rotational speed on the drive shaft 52 of the pump 50. This reduction in output speed helps increase torque. While four planet gears 180 are illustrated, any number of planet gears 180 may be employed, and the relative sizes of the gears 174, 176, 180 and number of teeth thereon as well as the design of the planet carrier 178 may also be changed as needed.

While use of a planetary gear system 170 offers compact size to the starting assist 54, other gear systems 62 are employable in the starting assist 54. In one embodiment, a two stage gear train of the gear system 172 includes a first stage 182 and a second stage 184. An input (drive shaft 60 of motor 58) is connected to a first gear 186 that engages with a second gear 188. The second gear 188 is rotatable on an intermediate shaft 190 and carries a smaller third gear 192 that engages with fourth gear 194. Rotation of the fourth gear 194 rotates the drive shaft 52 of the pump 50 accordingly. It should be understood that the gear system 172 is also illustrative only, and any variety of gear systems could be employed that provides the desired gear reduction.

Thus, the starting assist 54 includes a motor 58 that is geared down so that it overcomes the starting friction of the pump 50 before the motor 34 kicks on. The gear system 62 has a turn down ratio, of X:Y, with X>Y, where for every X revolutions of the driveshaft 60, there are Y revolutions of the driveshaft 52. By example only, if the turn down ratio is 100:1, for every 100 revolutions of the driveshaft 60, there is one revolution of the driveshaft 52, and while the number of revolutions goes down, the torque goes up. The gear ratio is the number of turns it takes on the input shaft to get one turn of the output shaft. Thus in a 100:1 gearbox, 100 turns of the input shaft are required to get a single turn of the output. That means the 100:1 gearbox will, in theory, generate on output torque 100 times as powerful as the input torque. In practice, this may not actually happen with such a high gear ratio, because of friction, but in general, a high gear ratio will give a high output torque multiple. In this embodiment, the driveshaft 60 of the motor 58 must spin relatively fast, even though the driveshaft 52 of the pump 50 is barely turning. The starting assist 54 gets the driveshaft 52 of the pump 50 turning so that the motor 34 doesn't have to, so as to avoid the big surge current. Also, the VFD 76 can be smaller for the motor 34 of the pump system 10, and the motor 34 itself can be smaller, as opposed to a motor 34 and VFD 76 used in a pump system without the starting assist 54. Thus, the pump system 50 having the starting assist 54 allows for low voltage AC induction motors 34 to be utilized where otherwise not technically feasible. Furthermore, by building the starting assist 54 into the pump 50, standard motors 34 can be chosen. Additionally, the use of an available grid power system as the electric power sources 78 and 82 is made possible since the inrush starting current for the motor 34 is substantially decreased and the motor 58 is small and substantially geared down.

In one embodiment, the pump system 10 includes, or is operatively communicable with, a controller 100. The controller 100 may control the motor 58 to turn on (and draw power from the electrical power source 82) or turn off, or to turn the shaft 60 at a particular speed if available. Thus, the controller 100 may activate the starting assist 54, or alternatively an operator may turn on the starting assist 54. The controller 100 may also control the motor 34 to turn on or off or turn the shaft 36 at a particular speed, or may alternatively control the motor 34 through the VFD 76. Prior to turning on the motor 34, the controller 100 may receive data from the pump 50 indicative of the rotation speed of the shaft 52. An algorithm within the controller 100 may utilize the data to determine when the initial starting friction of the pump 50 has been overcome and may then subsequently instruct the motor 34 to turn on and draw power from the electrical power source 78. Once the pump 50 has started to slowly turn, information may be sent to the controller 100 to indicate when the motor 34 should be started. For example, the motor 34 may be started when a target rotational speed of the drive shaft 52 has been reached, or may be started after a preset time in which the motor 58 has been run. Alternatively, the pump system 100 may include a display displaying information about the speed of the drive shaft 52 and an operator may then choose to turn on the motor 34. The pump system 10 may include any number of sensors within any of the components of the pump system 10 to communicate with the controller 100 to operate the pump system 10 using the starting assist 54. The operation of the pump system 10 may further include turning the starting assist 54 off after the target rotational speed of the drive shaft 52 has been reached. In one embodiment, a shaft position encoder 102 on the drive shaft 52 allows intelligent synchronization of the drive shaft 36 and rotor position of the drive shaft 52. This prevents an out of phase (short duration) misalignment. In one embodiment, turning on the motor 34 moves the drive shaft 36 into coupling engagement with the drive shaft 52.

When pumping against a closed valve, a pressure test must be performed before the job. Pressure testing is improved by using the pump system 10 with the above-described starting assist 54. Providing high torque, low speed control of the pump 50 using the starting assist 54 significantly assists in preventing over-pressuring of the iron (high pressure piping) and/or fluid ends of the pump 50. By utilizing the small motor 58 that is geared way down, an operator can slowly build up pressure because the driveshaft 52 of the pump 50 is barely turning with increased rotation of the driveshaft 60. For example, the iron may be compromised and need to be replaced if pressure from the pump 50 goes over 15,000 psi in the iron (piping). If just an eighth of a turn on the pump 50 results in a couple hundred or even 1,000 pounds of pressure increase, the gear reduction provides fine resolution for adjustment on pressure, especially when the pressure gets above 10,000 pounds. Likewise, in cementing operations, the pump system 50 having the starting assist 54 also allows precision cement delivery.

The methods that may be described above or claimed herein and any other methods which may fall within the scope of the appended claims can be performed in any desired suitable order and are not necessarily limited to any sequence described herein or as may be listed in the appended claims, unless otherwise stated. Further, the methods of the present invention do not necessarily require use of the particular embodiments shown and described herein, but are equally applicable with any other suitable structure, form and configuration of components.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A pump system comprising:

a pump having a crankshaft;

a pump motor selectively engaged with an end of the crankshaft; and a starting assist comprising a starting assist motor, a starting assist drive shaft coupled with the starting assist motor, and a gear set having an end coupled to the starting assist drive shaft and an opposing end coupled to and disposed adjacent an end of the crankshaft distal from the end of the crankshaft engaged with the pump motor, so that when the starting assist motor is energized, rotational power from the starting assist motor is transferred through the gear set and to the crankshaft.

2. The pump system of claim 1, wherein the pump motor is energized and coupled to the crankshaft a period of time after commencing operation of the starting assist motor.

3. The pump system of claim 1, wherein the crankshaft is disengaged from the pump motor when operation of the starting assist motor is initiated.

4. The pump system of claim 1, wherein the pump motor and starting assist motors draw electrical power from a grid power system.

5. The pump system of claim 2, wherein the starting assist motor has a smaller power rating than a power rating of the pump motor.

6. The pump system of claim 2, further comprising a controller, wherein the controller receives rotational frequency data from the pump and activates the pump motor and deactivates the starting assist motor when the crankshaft rotates at a preset rotational frequency.

7. The pump system of claim 2, further comprising a variable frequency drive connected to the pump motor.

8. The pump system of claim 2, further comprising a transportable chassis, the pump assembly and pump motor positioned on the chassis.

9. The pump system of claim 1, wherein the gear set has a gear ratio of X:Y, where X>Y.

10. The pump system of claim 9, wherein the gear set is a planetary gear system.

11. The pump system of claim 10, wherein the planetary gear system includes a sun gear, a plurality of planet gears that engage and are circumscribed by a ring gear, and a planet carrier coupled with each of the planet gears, a driveshaft of the starting assist motor connected to the sun gear and the crankshaft connected to the planet carrier.

12. The pump system of claim 9, wherein the gear system is a fixed axis gear train.

13. The pump system of claim 1, wherein a rotational torque at a connection between the gear set and the crankshaft is greater than that at a connection between the gear set and the starting assist motor.

14. The pump system of claim 1, further comprising a shaft position encoder operatively engaged with the crankshaft for synchronization of a pump motor drive shaft that is connected to the pump motor, and a starting assist drive shaft that is connected to the starting assist drive shaft.

15. A method of operating a pump used in downhole operations comprising:

obtaining a pump system comprising, a pump having a crankshaft, a pump motor selectively engaged with an end of the crankshaft, and a starting assist comprising, a starting assist motor, a starting assist drive shaft coupled with the starting assist motor, and a gear set having an end coupled to the starting assist drive shaft and an opposing end coupled to and disposed adjacent an end of the crankshaft distal from the end of the crankshaft engaged with the pump motor; and rotating an end of the crankshaft opposite from where the crankshaft is engaged with the pump motor by energizing the starting assist motor.

16. The method of claim 15, energizing the pump motor a period of time after commencing operation of the starting assist motor.

17. The method of claim 15, wherein the gear system has a gear ratio of X:Y, where X>Y.

18. The method of claim 15, wherein the pump motor is activated when the crankshaft rotates at a preset frequency.

19. The method of claim 15, further comprising conducting a cementing operation prior to activating the pump motor.

20. The method of claim 15, wherein activating the pump motor includes moving a drive shaft coupled with the pump motor to couple with the crankshaft.

21. The method of claim 15, wherein the pump system is employed in a well operation including at least one of hydraulic fracturing, stimulation, tracer injection, cleaning, acidizing, steam injection, water flooding, and cementing.

* * * * *